US007849626B2

(12) United States Patent
Fluhr

(10) Patent No.: US 7,849,626 B2
(45) Date of Patent: Dec. 14, 2010

(54) ADJUSTABLE SHOULDER STOCK APPARATUS FOR USE WITH FIREARMS

(75) Inventor: Norbert Fluhr, Oberndorf (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 12/324,577

(22) Filed: Nov. 26, 2008

(65) Prior Publication Data

US 2009/0139128 A1 Jun. 4, 2009

Related U.S. Application Data

(63) Continuation of application No. PCT/EP2007/004525, filed on May 22, 2007.

(30) Foreign Application Priority Data

May 29, 2006 (DE) ..... 10 2006 024 961
Jul. 18, 2006 (DE) ..... 10 2006 033 259

(51) Int. Cl.
*F41C 23/00* (2006.01)

(52) U.S. Cl. ..... 42/73; 42/75.03

(58) Field of Classification Search ..... 42/71.01, 42/72, 73, 75.03

See application file for complete search history.

(56) References Cited

U.S. PATENT DOCUMENTS 3,348,328 A * 10/1967 Roy ..... 42/73
4,615,134 A * 10/1986 Beretta ..... 42/6
4,735,007 A 4/1988 Gal
6,732,466 B2 * 5/2004 Bentley ..... 42/74
7,162,822 B1 * 1/2007 Heayn et al. ..... 42/73
2004/0031182 A1 2/2004 Bentley
2006/0254111 A1 * 11/2006 Giauque et al. ..... 42/72

FOREIGN PATENT DOCUMENTS

DE 1553855 6/1971
DE 10 2004 027 123 B3 8/2005

OTHER PUBLICATIONS

International Searching Authority, International Search Report for PCT/EP2007/004525, Sep. 14, 2007, 6 pages.
International Searching Authority, Written Opinion for PCT/EP2007/004525, Sep. 14, 2007, 8 pages.
International Bureau, "International Preliminary Report on Patentability", issued in connection with counterpart PCT application Serial No. PCT/EP2007/004525, mailed Jan. 20, 2009 (7pages).

* cited by examiner

*Primary Examiner*—Michael Carone
*Assistant Examiner*—Daniel J Troy
(74) *Attorney, Agent, or Firm*—Hanley, Flight and Zimmerman, LLC

(57) ABSTRACT

Adjustable shoulder stock apparatus for use with firearms are described. An example adjustable shoulder stock apparatus for use with firearms includes a shoulder stock into which a connecting piece of the firearm is to be inserted. The connecting piece defines a plurality of boreholes. Additionally, the example adjustable shoulder stock apparatus includes a bolt having a end to be inserted in one of the plurality of boreholes to secure the shoulder stock relative to the connecting piece. Further the example adjustable shoulder stock apparatus includes a lever that defines a recess that is open toward a top of the firearm and is closed toward a bottom of the firearm. An opposite end of the bolt is positioned in the recess and coupled to the lever. The lever is to remove the bolt from the one of the plurality of boreholes. The lever comprises a projection to engage a wall of the shoulder stock to prevent movement of the lever past the wall. Further still, the example adjustable shoulder stock apparatus includes a cross pin positioned through the bolt to couple the bolt to the lever, wherein the cross pin does not protrude beyond a molded material of the lever and a plurality of lateral flanks of the shoulder stock in which the lever is positioned.

19 Claims, 5 Drawing Sheets

(Stand der Technik)

(Stand der Technik)

ADJUSTABLE SHOULDER STOCK APPARATUS FOR USE WITH FIREARMS

RELATED APPLICATIONS

This patent is a continuation of International Patent Application Ser. No. PCT/EP2007/004525, filed May 22, 2007, which claims priority to German Patent Application 10 2006 024 961.5, filed on May 29, 2006 and to German Patent Application 10 2006 033 259.8, filed on Jul. 18, 2006, each of which are hereby incorporated herein by reference in their entireties.

FIELD OF THE DISCLOSURE

This patent relates generally to adjustable shoulder stock apparatus and, more specifically, to adjustable shoulder stock apparatus for use with firearms.

BACKGROUND

Known firearms such as, for example, the M16 rifle or the M4 carbine, are provided with an incrementally adjustable shoulder stock, which may be completely removed from the firearm. A known adjustable shoulder stock is described in DE-OS 1553 885, which is depicted in FIGS. 1 and 2.

The shoulder stock 1 of FIGS. 1 and 2 includes a base plate 3 having a connecting piece (not shown) that is inserted into a portion (not shown) along an axis 102 of the shoulder stock 1 from the rear. The connecting piece defines a plurality of boreholes (not shown) that are opened toward the bottom of the shoulder stock 1. Additionally, the shoulder stock 1 includes a bolt 7 that is positioned substantially perpendicular relative to the axis 102. A spring (not shown) urges the bolt 7 upward and toward one of the plurality of boreholes. In operation, to secure the shoulder stock 1 relative to a firearm (not shown), the bolt 7 is urged upward by the spring and guided by a bore 104 of the shoulder stock 1 toward one of the plurality of boreholes into which the bolt 7 is received.

To couple the bolt 7 to a lever 9, a portion of the bolt 7 is positioned in a through hole 106 defined by the lever 9 and a cross pin 13 is inserted into an aperture 108 defined by the bolt 7. The cross pin 13 extends out of the aperture 108 through a first opening 110 and a second opening (not shown), which is opposite the first opening 110. The cross pin 13 may be pounded into the aperture 108, bent on either side, or may be a spring bolt. The lever 9 may be formed from a sheet metal material or a plastic material. In operation, the interaction between the spring, the bolt 7 and the lever 9, applies a force to the lever 9 that urges the lever 9 toward the shoulder stock 1.

A lower portion 15 (e.g., a cross bar) is positioned below an upper portion 112 of the shoulder stock 1 and extends longitudinally from the rear toward the front of the shoulder stock 1. Additionally, the lower portion 15 is partially positioned in a channel (not shown) defined by the lever 9. The interaction between the lower portion 15 and the lever 9 axially positions the lever 9 relative to the trigger (not shown) of the firearm and substantially prevents the lever 9 from twisting relative to the shoulder stock 1. Additionally, a gap 114 may be provided between the lower portion 15 and the lever 9.

The lever 9 is rotatable about an edge (not shown) adjacent the bolt 7 defined by the shoulder stock 1. In operation, to adjust the shoulder stock 1 relative to the firearm, the lever 9 is rotated relative to the shoulder stock 1 by applying a force to the lever 9 in a direction generally represented by arrow 116. As an end 17 (e.g., a rear end) of the lever 9 rotates toward a surface 118 of the shoulder stock 1, the lever 9 engages the cross pin 13, which moves the bolt 7 away from the borehole in which it is positioned. Specifically, the force applied to the bolt 7 via the lever 9 overcomes the force applied to the bolt 7 via the spring. Once the bolt 7 is disengaged from the borehole, the shoulder stock 1 may be adjusted (e.g., horizontally adjusted) relative to the firearm to a desired position.

In some instances, the lever 9 may be moved to adjust the shoulder stock 1 relative to the firearm without significant interruption during operations. Additionally, the connecting piece includes a downward protruding stop (not shown) that may be engaged by the bolt 7 when the shoulder stock 1 is fully extended (e.g., pulled toward the rear of the firearm) to prevent the shoulder stock 1 from being accidently removed from the firearm. However, when a significant force is applied to the end of the lever 9, the bolt 7 may be moved to a distance from the connecting piece such that there is a clearance (e.g., a gap) between an end (not shown) of the bolt 7 and the downward protruding stop and, thus, the shoulder stock 1 may be completely removed from the firearm.

As a result, during operation, the lever 9 may be accidently released if the end 17 of the lever 9 becomes entangled in a marksman's clothing and inadvertently moves the lever 9 downward such that a distance of the gap 114 decreases. Similarly, during operation, the lever 9 may be accidently released by rapid hand movements by the marksman in which a force is applied to the lever 9. In both instances, the marksman may inadvertently adjust or completely remove the shoulder stock 1 from the firearm.

Additionally, because the end 17 of the lever 9 protrudes relative to the shoulder stock 1, during training or combat missions, tree branches or other objects are susceptible to becoming entrapped between the end 17 and the shoulder stock 1. Additionally, the marksman may reach behind the end 17 and be injured by the lever 9 when the firearm recoils.

In an attempt to avoid some of the above described problems, the end 17 of the lever 9 may be rounded or beveled. However, to achieve the necessary leverage to rotate the lever 9 somewhat effortlessly, the lever 9 must thereafter be extended toward the rear of the shoulder stock 1 the length which was removed during rounding or beveling. As a result, the number of the plurality of bores defined by the connecting piece that enables adjustability is decreased, because the length of the shoulder stock 1 is increased.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis. While the example shoulder stock is described as being implemented on a firearm, the example shoulder stock may be advantageously utilized with any other suitable device such as, for example, an aiming device used during training exercises.

The examples described herein improve handling of shoulder stocks used with firearms. In particular, the examples described herein improve handling without sacrificing desired characteristics such as, for example, relatively short length, adjustability, and/or low production cost.

Figure 3:
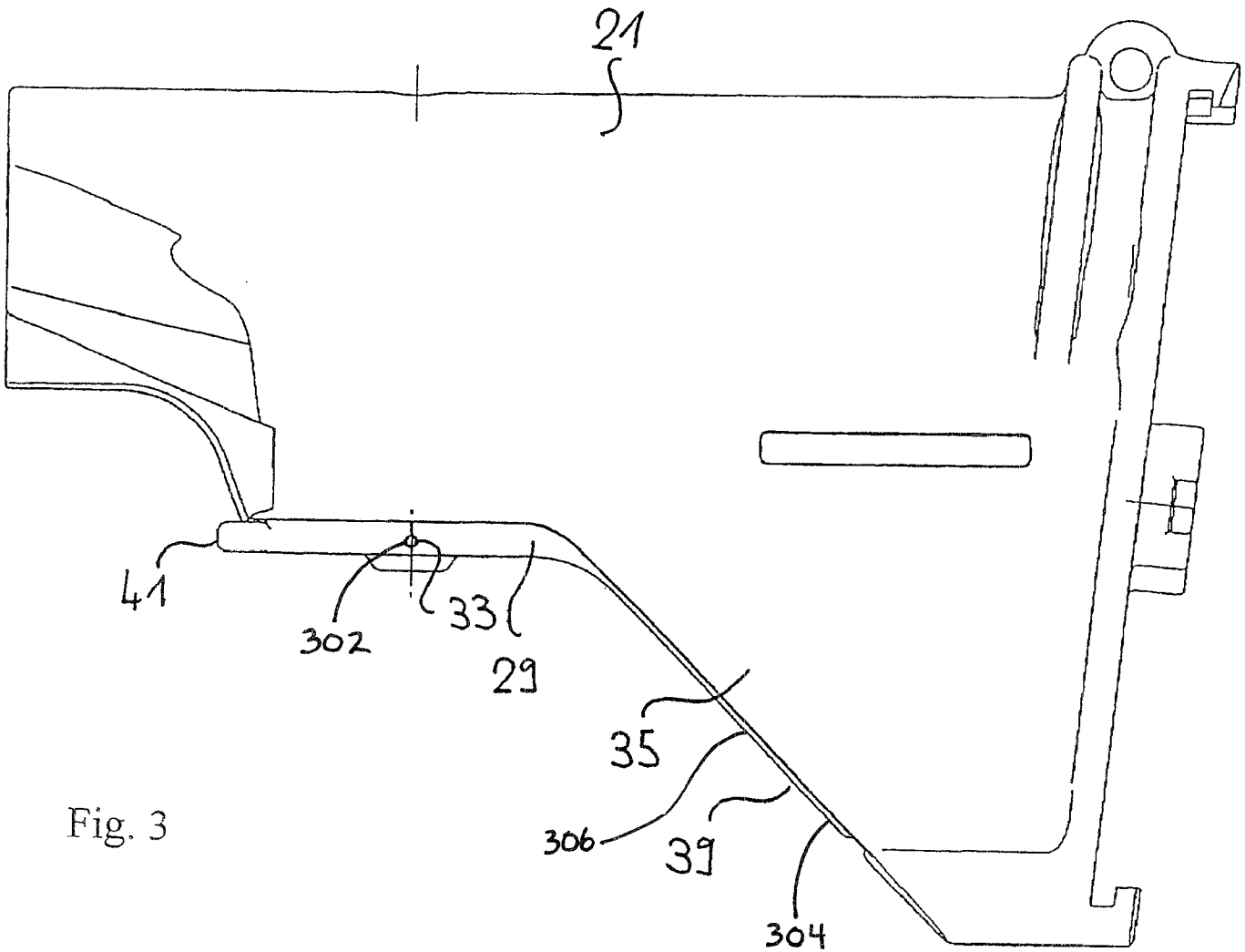
FIG. 3 depicts a side view of an example disclosed shoulder stock.

FIG. 3 depicts an example shoulder stock 21 including a lever 29, which may be made of a plastic material, that slightly protrudes from the shoulder stock 21. Additionally, an insert or cross pin 33 is inserted into an aperture 302 of the lever 29 and a bolt or insert 27 (e.g., an offset bolt). In contrast to the cross pin 13 of FIG. 1, the cross pin 33 does not protrude from the aperture 302, which prevents the cross pin 33 from catching on, for example, the marksman's clothing. The lever 29 has an angled portion 304 including ribbing 306 that is adjacent a point of application 39 (e.g., portion). The point of application 39 is the point or area at which the marksman pushes the lever to adjust the shoulder stock 21. Toward the front of the lever 29, an actuating portion or lip 41 protrudes toward the front of the shoulder stock 21. To substantially ensure that the lever 29 is not inadvertently rotated and/or activated, the shoulder stock 21 is provided with a plurality of lateral flanks or side portions 35 that cover a majority of the lever 9.

Figure 4:
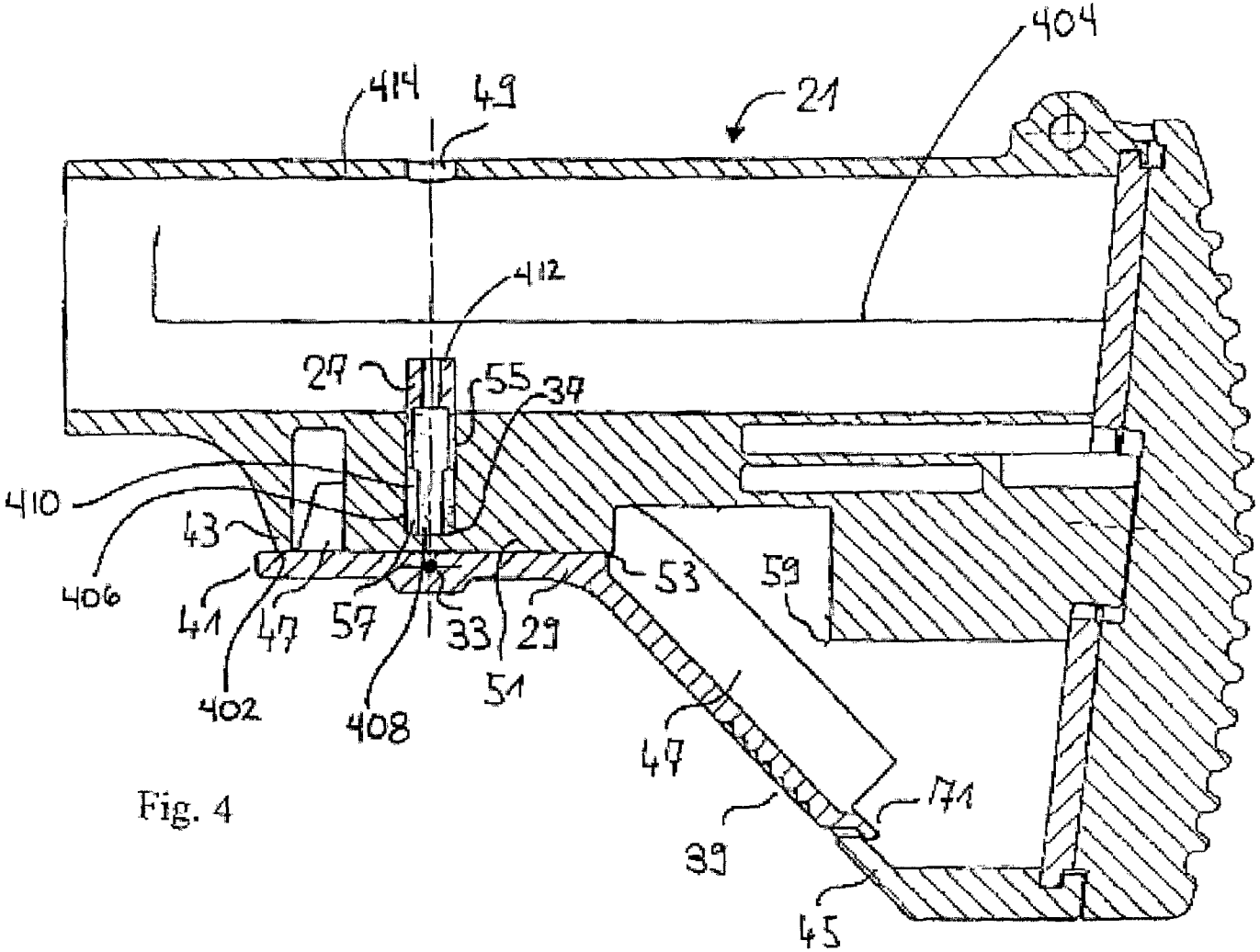
FIG. 4 depicts a side view in section of the example disclosed shoulder stock of FIG. 3.

FIG. 4 illustrates that the lever 29 includes a plurality of lateral walls 47 (e.g., a portion) that extend inwardly relative to the shoulder stock 21 adjacent the respective lateral flank 35. In some examples, the plurality of lateral walls 47 sealingly engage the lateral flanks 35 to substantially prevent moisture, fluid and/or debris (e.g., dirt) from entering the shoulder stock 21. Additionally, the interaction between the lever 29 and the lateral flanks 35 substantially retains the lever 29 in a position relative to the shoulder stock 21, which shields the lever 29 from exterior influences.

A surface 402 of the lever 29 engages a front wall or portion 43 of the shoulder stock 21. Additionally, the surface 402 of the lever 29 engages a block 51 that is positioned toward the rear of the shoulder stock 21. To enable the lever 29 to pivot relative to the shoulder stock 21, a swivel edge 53 (e.g., a hinge edge) is positioned toward the rear of the block 51.

The block 51 defines a borehole or aperture 55 that is substantially perpendicular to an axis 404. The borehole 55 includes a tapered surface 406 toward the bottom of the block 51. The bolt 27 is at least partially positioned in the borehole 55. A spring 57 (FIG. 5) is positioned adjacent the tapered surface 406 in a recess 37 defined by the block 51 around an elongated portion 408 of the bolt 27, which defines a recess 410. Additionally, a tension member 31 (FIG. 5) is positioned between the cross pin 33 and a top side 412 (e.g., an end) of the bolt 27.

Figure 5:
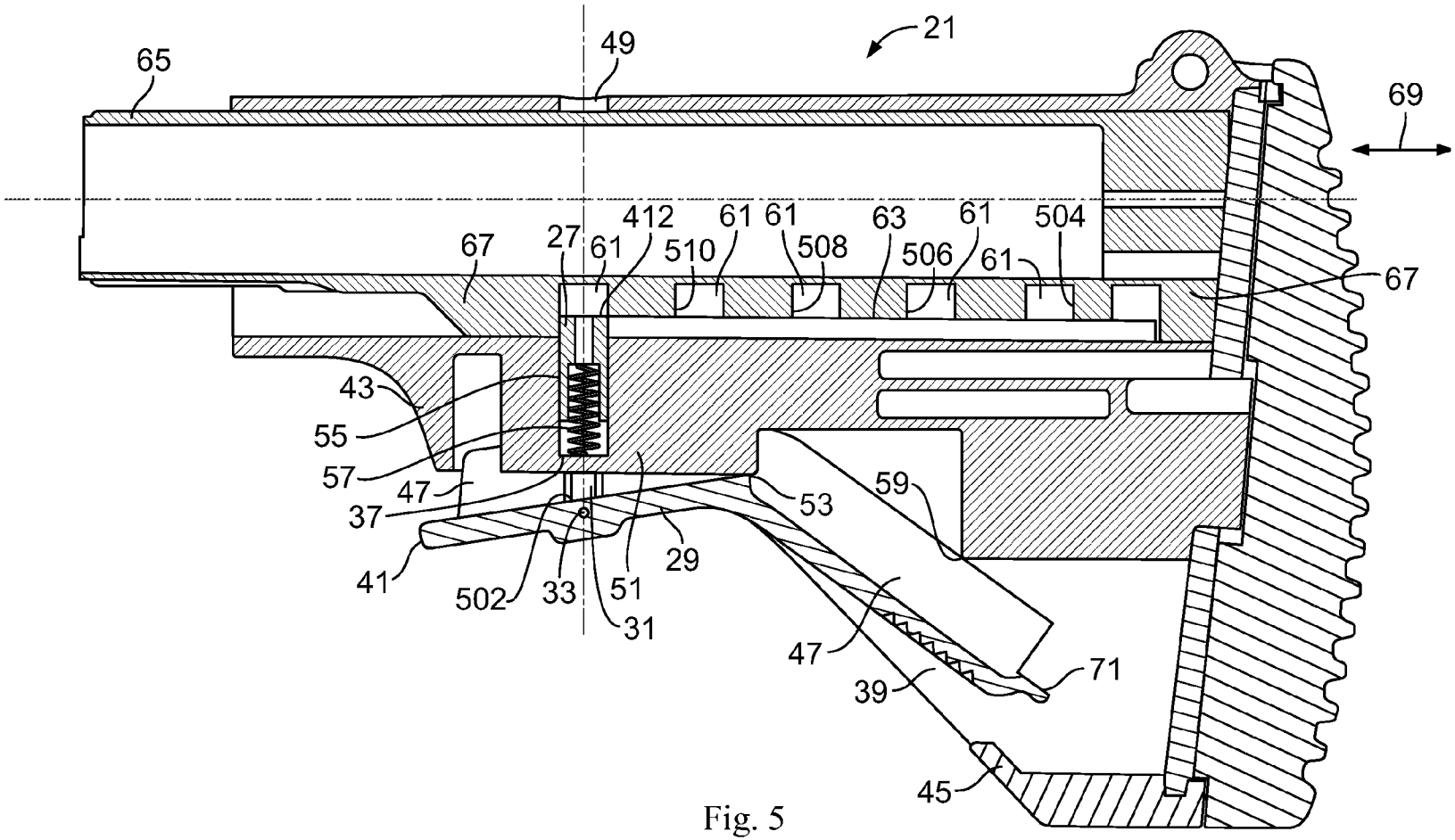
FIG. 5 depicts another side view in section of the example disclosed shoulder stock of FIG. 3 in which the lever has been actuated to allow adjustment of a length of the example disclosed shoulder stock.

The bolt 27 is partially positioned in a blind hole or recess 502 (FIG. 5) defined by the lever 29 that is open toward the top of the lever 9. The shoulder stock 21 defines a borehole or aperture 49 through a wall 414 into which, during assembly, the bolt 27 is inserted and/or pressed downward against a force exerted by the spring 57 (FIG. 5). To prevent debris from entering the aperture 49 and/or the shoulder stock 21, the aperture 49 may be sealed by any suitable means after the bolt 27 has been inserted into the shoulder stock 21.

FIG. 5 depicts the lever 29 being depressed. In operation, after a force is exerted, for example, via a finger of the marksman, against the point of application 39, the lever 29 pivots about the swivel edge 53 and the angled portion 304 (FIG. 3) of the lever 29 moves toward an edge 59 (e.g., a front edge) of the shoulder stock 21. As the lever 29 moves toward the edge 59, the interaction between the cross pin 33, the bolt 27 and the lever 28 moves the bolt 27 downward until the lateral walls 47 of the lever 29 engage the edge 59.

The firearm is provided with a connecting piece 65 that defines a plurality of boreholes or apertures 61 each having an opening 504, 506, 508, and 510 adjacent a lower surface 64. The surface 64 abuts a front and rear block 67 each of which protrude downward relative to the shoulder stock 21. If the lever 29 is rotated such that the lateral walls 47 engage the edge 59, the top side 412 of the bolt 27 is positioned directly beneath a lower surface 63, which advantageously removes the bolt 27 from any of the boreholes 61 and, thereby, enables the shoulder stock 21 to be adjusted relative to the connecting piece 65 and, thus, the firearm, in a direction generally represented by arrow 69. If the lever 29 is released, the bolt 27 moves upward toward the lower surface 63 and thereafter penetrates one of the plurality of boreholes 61, which securely positions the shoulder stock 21 relative to the connecting piece 65.

Figure 2:
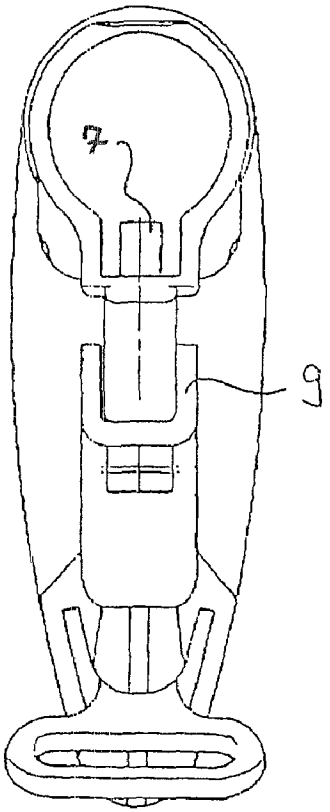
FIG. 2 depicts an end view of the known shoulder stock from the direction indicated by II in FIG. 1.
Figure 1:
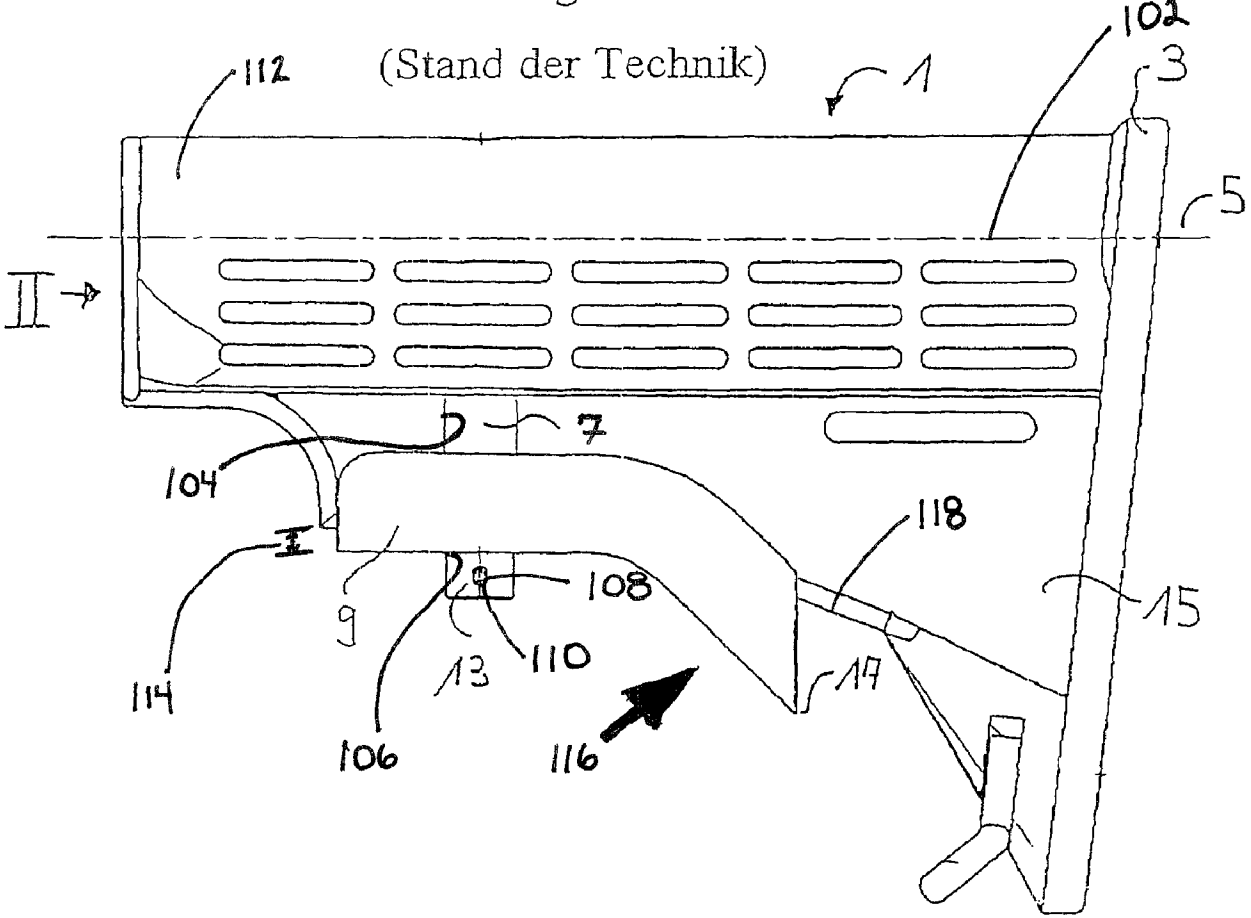
FIG. 1 depicts a side view of a known shoulder stock.

In contrast to the known shoulder stock 1 of FIGS. 1 and 2, if the shoulder stock 21 is moved toward the rear of the firearm while the lateral walls 47 engage the edge 59, the bolt 27 is not retracted far enough not to engage the rear block 67, which advantageously ensures that the shoulder stock 21 is not inadvertently removed from the connecting piece 65. Additionally, the interaction between the lateral walls 47 and the edge 59 ensures that the bolt 27 does not move beneath either of the front or rear blocks 67 during normal operation, which eliminates the limitations encountered with known shoulder stocks.

To remove the shoulder stock 21 from the connecting piece 56, the marksman grasps the lip 41 and exerts a force against the lever 29 in a direction generally represented by arrow 602. As the lever 29 is pulled downward, the interaction between the lateral walls 47 and the edge 59 pivots the lever 29 relative to the shoulder stock 21 and moves the bolt 27 downward against the force exerted by the spring 57 until the top side 412 of the bolt 27 is beneath a horizontal surface 604 of the rear block 67. Thereafter, the shoulder stock 21 can be removed from the connecting piece 65 by pulling the shoulder stock 21 in a direction generally represented by arrow 69 toward the rear of the firearm.

To removably couple the shoulder stock 21 to the connecting piece 65, initially, a force is applied to the point of application 39 on the lever 29 to move the lever 29 until the lateral walls 47 engage the edge 59. The marksman then grasps the lip 41 and further pulls the lever 29 downward until the top side 412 is at or below a surface 606 of the shoulder stock 21. The connecting piece 65 is then inserted in a bore 608 of the shoulder stock 21 and the lever 29 is released when the bolt 27 is positioned adjacent the intended borehole 61. The surface 402 of the lever 29 then moves toward the front portion 43 of the shoulder stock 21 and the bolt 27 positions itself in the selected borehole 61 to attain the desired length of the shoulder stock 21 relative to the firearm. In this position, an end or projection 71 of the lever 29 engages a wall 45 (e.g., a transverse wall) of the shoulder stock 21 and the surface 402 engages a lower surface 610 of the front portion 43 and a lower surface 612 of the block 51. In particular, a sealing engagement of the projection 71 relative to the wall 45, a sealing engagement of the lip 41 relative to the front portion 43 and/or a sealing engagement of the lateral walls 47 relative to the lateral flanks 35 advantageously ensure that the amount of moisture or fluid that penetrates the shoulder stock 21 is limited and/or substantially eliminated, which increases the useful life of certain components in the shoulder stock 21. Specifically, limiting the amount of moisture that the spring 57 and/or the bolt 27 are exposed to, decreases the likelihood that these components will rust.

The examples described herein relate to a shoulder support apparatus that includes the shoulder stock 21 into which the connecting piece 65 can be inserted from the rear of the firearm. The connecting piece 65 includes the plurality of boreholes 61 into which the bolt 27 may be positioned to achieve the desired shoulder stock 21 length. In particular, the top side 412 of the bolt 27 is positioned in one of the plurality of boreholes 61. Additionally, the shoulder support apparatus includes the lever 29 that is coupled (e.g., pivotably coupled) to the bolt 27 and is configured to move the bolt 27 downward to remove the bolt 27 from the borehole 61 in which it is positioned to enable the shoulder stock 21 to be adjusted relative to the connecting piece 65. Additionally, the lever 29 defines the blind hole 502 in which the bolt 27 is positioned. The blind hole 502 is open toward the top of the lever 29, but is closed toward the bottom of the lever 29.

To couple the bolt 27 to the lever 29, the cross pin 33 is inserted into the aperture 302 of the bolt 27 and the lever 29 such that the cross pin 33 does not extend out of the lever 29. In particular, the cross pin 33 does not protrude from the molded material of the lever 29. Additionally, the lateral flanks 35 of the shoulder stock 21 surround a majority of the lever 29. Specifically, the lateral flanks 35 are positioned adjacent the lateral walls 47 of the lever 29. Additionally, the lever 29 includes the projection 71 that is configured to engage the wall 45 of the shoulder stock 21 in, for example, a closed or a resting position, to ensure that the lever 29 can not be gripped from behind or move toward the front of the shoulder stock 21 past the wall 45. Specifically, in contrast to the lever 9 of FIGS. 1 and 2 that includes the end 17 that may be become entangled with objects during training or combat missions, the projection 71 prevents the lever 29 from extending beyond the wall 45 and, thus, overcomes the limitations encountered by known shoulder stocks.

Preferably, the lever 29 is fabricated, manufactured and/or produced from a molded material. In particular, the lever 29 may be molded through any suitable means such as, for example, die casting, plastic molding, etc., which, if any, requires minimal finishing work such as, for example, removing sprues, excess material, etc. Known levers may have first been used in 1936 in the M1 Garand rifle, which included a zinc lever that required extensive finishing work. In contrast, the example lever 29 is preferably made of hard plastic material that enables the lever 29 to be installed with little if any additional finishing work.

As discussed above, the cross pin 33 is inserted into the aperture 302 such that it does not extend out of the molded material of the lever 29. An interference fit between the cross pin 33 and the aperture 302 of the bolt 27 prevents the cross pin 33 from being accidentally removed. The bolt 27 is positioned relative to the lever 29 with greater precision if, for example, the lever 29 is made from a molded material, than would typically be possible if the lever 29 was made of a bent part (e.g., a formed piece of metal material). Additionally, the blind hole 502 into which the bolt 27 is positioned is open toward the top of the lever 29 and closed toward the bottom of the lever 29, which prevents moisture, dirt, etc., from entering the shoulder stock 21 through the blind hole 502 and/or the borehole 55. However, in other examples, the lever 29 may define a through hole (not shown) instead of the blind hole 502.

As described above, because the cross pin 33 does not extend out of the lever 29, the clothing of the marksman is unable to become entangled on the cross pin 33. Additionally, the lever 29 is provided with the lip 41 that does not obstruct the marksman during normal operation, but may be grasped to pull the lever 29 downward to remove the shoulder stock 21 from the connecting piece 65. Further, the lever 29 is substantially protected against exterior influences such as, for example, lateral impacts, by the lateral flanks 35.

The examples described herein, overcome the limitations encountered by known shoulder stocks while still being cost-effectively produced. Specifically, the examples described herein may be produced more cost-effectively than known shoulder supports in larger production capacities.

Figure 6:
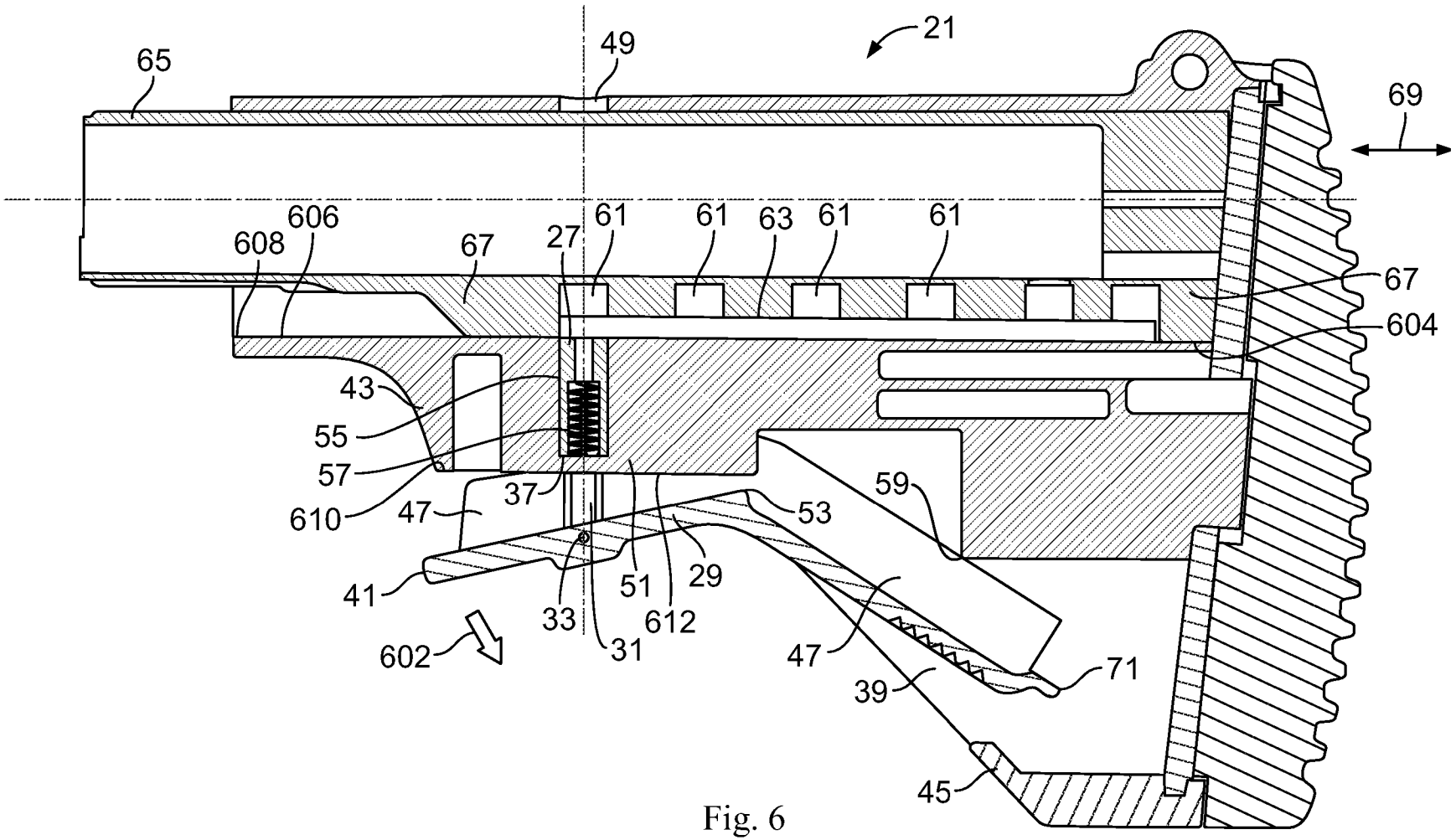
FIG. 6 depicts another side view in section of the example disclosed shoulder stock of FIG. 3 in which the lever has been pulled down to allow removal of the example disclosed shoulder stock from the connecting piece.

As discussed above, the tension member 31 is positioned between the cross pin 33 and the top side 412 of the bolt 27. The interaction between the tension member 31, the cross pin 33, and the bolt 27 forms a hinge that enables the bolt 27 to move relatively vertically while the lever 29 moves in a direction generally represented by the arrow 602 (FIG. 6), which is in a slightly horizontal direction. In particular, the tension member 31 is positioned between the cross pin 33 and the top side 412 of the bolt 27, which enables the bolt 27 to move relatively vertically while the lever 29 moves in a slightly horizontal direction. Specifically, the cross pin 33 enables the lever 29 to pivot relative to the tension member 31 and/or the bolt 27.

As described above, the bolt 27 is positioned in the borehole 55 having the tapered surface 406. The spring 57 (e.g., a spiral shaped spring) is positioned in the recess 37 defined by the block 51 and surrounds the elongated portion 408 (e.g., a lower section of the bolt 27). In some examples, the borehole 55 may be filled with grease or any other suitable substance to decrease the likelihood that the spring 57 will rust and/or its resilience will decrease.

As discussed above, the surface 402 of the lever 29 is to be positioned adjacent the block 51, which substantially prevents and/or limits the amount of moisture that penetrates an interior of the shoulder stock 21. Additionally, the swivel edge 53 interacts with the block 51 to enable the lever 29 to pivot relative to the shoulder stock 21 and, thus, to adjust the shoulder stock 21 relative to the connecting piece 65.

Preferably, the swivel edge 53 is positioned at a distance from the edge 59, which is engaged by the lateral walls 47 of the lever 29 when the lever 29 is moved to adjust the length of the shoulder stock 21. The engagement of the lateral walls 47 against the edge 59 ensures that the top side 412 of the bolt 27 does not move beneath the horizontal surface 604 and, thus, the shoulder stock 21 is unable to be removed from the connecting piece 56 during normal operation. The edge 59 is positioned adjacent the point of application 39, which reduces the amount of flexural stresses. Additionally, the position of the ribbing 306 on the lever 29 ensures that the point of application 39 where the marksman typically presses the lever 29 to rotate the lever 29 relative to the shoulder stock 21 is opposite the edge 59.

While the lever 29 itself may be pulled downward when removing the shoulder stock 21 from the connecting piece 65, preferably, the marksman grasps the lip 41 to further pull the lever 29 downward and pivot the lever 29 relative to the edge 59 to enable the shoulder stock 21 to be removed from the connecting piece 65. In particular, as the lip 41 is moved in a direction generally represented by the arrow 602, the top side 412 of the bolt 27 is moved beneath the horizontal surface 604 of the rear block 67 and thereafter the shoulder stock 21 may be removed from the connecting piece 65 toward the rear of the firearm. Removing the shoulder stock 21 from the firearm, typically requires two hands, one that grasps the lip 41 and the other to remove the shoulder stock 21 from the firearm. As such, unintentional removal of the shoulder stock 21 is practically impossible. In some examples, the lip 41 may protrude slightly toward the front of the shoulder stock 21. However, in other examples, the lip 41 does not protrude from the shoulder stock 21. In particular, in some examples, the lip 41 may only be grasped by the marksman when the lateral walls 47 of the lever 29 have been moved toward the edge 59.

As described above, in the resting position, the lip 41 of the lever 29, is positioned adjacent the front portion 43 of the shoulder stock 21. The lip 41 slightly protrudes to the front of the shoulder stock 21 to enable the marksman to grasp the lip 41 when the lever 29 has been slightly rotated, but prevents the lip 41 from being grasped if the lever 29 has not been rotated. Additionally, the front portion 43 provides a reliable support for the lever 29 even if production tolerances are taken into account.

As discussed above, the lever 29 includes the projection 71 that engages the wall 45 of the shoulder stock 21, which prevents the lever 29 from being gripped from underneath. Additionally, in the resting position, the lateral flanks 35 and other portions of the shoulder stock 21 (e.g., a wall of the shoulder stock 21 toward the front of the lever 29) substantially cover the lever 29 such that only certain portions of the lever 29 are exposed (e.g., the lip 41, the ribbing 306, etc.). The lever 29 includes the angled portion 304 that is surrounded by the lateral flanks 35 of the shoulder stock 21 and the projection 71 of the lever 29 engages the wall 45 of the shoulder stock 21, both of which ensure that the lever 29 may only be operated by pushing the lever 29 between the lateral flanks 35 toward the edge 59. In operation, the position of the lever 29 relative to the lateral flanks 35 ensures that a tree branch or other object that may become entangled in the shoulder stock 21 only presses against the lateral flanks 35 and does not exert a force on the lever 29, which prevents unintentional rotation and/or activation of the lever 29.

During training or combat missions in damp terrains, after the shoulder stock 21 has been adjusted to the desired length, grease or any other suitable substance may be advantageously utilized to completely seal the counters of the lever 29 to further prevent moisture from entering the interior of the shoulder stock 21. Additionally, in contrast to known shoulder stocks and levers, the lever 29 is not provided with projections that, during operations or firing of the firearm, can get caught on objects or injure the marksman's hand when, for example, the firearm recoils. The examples described herein, enable the lever 29 to be positioned substantially flat relative to the shoulder stock 21, which eliminates the limitations encountered with known shoulder stocks. Additionally, the sealing engagement between the lever 29 and the shoulder stock 21 prevents moisture, fluid, debris, etc. from entering the interior of the shoulder stock 21 without increasing production costs.

As described above, the shoulder stock 21 and/or the lever 29 may be made of a plastic material. As such, the shoulder stock 21 and/or the lever 29 may be resistant to sea water and may be produced with relatively less production costs as compared to known designs, which are made of an aluminum allow material. The examples described herein are considerably lighter than known shoulder stocks and significantly safer to handle.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An adjustable shoulder stock apparatus for use with firearms, comprising:

a shoulder stock into which a connecting piece of a firearm is to be inserted, wherein the connecting piece defines a plurality of boreholes;

a bolt having an end to be inserted in one of the plurality of boreholes to secure the shoulder stock relative to the connecting piece;

a lever that defines a recess that is open toward a top of the firearm and is closed toward a bottom of the firearm, wherein an opposite end of the bolt is positioned in the recess and coupled to the lever and wherein the lever pivots on a first edge of the lever to remove the bolt from the one of the plurality of boreholes, wherein the lever comprises a projection to engage a wall of the shoulder stock to prevent movement of the lever past the wall;

a second edge of the shoulder stock to be engaged by a portion of the lever when the lever is pivoted on the first edge a distance relative to the shoulder stock to adjust a position of the shoulder stock relative to the connecting piece, wherein the lever is pivotable about the second edge to remove the shoulder stock from the connecting piece;

a swivel cross pin positioned through the bolt to pivotably couple the bolt to the lever, wherein the swivel cross pin does not protrude beyond a molded material of the lever; and a plurality of lateral flanks of the shoulder stock between which the lever is positioned.

2. The adjustable shoulder stock apparatus as defined in claim 1, further comprising a tension member positioned between the swivel cross pin and the bolt.

3. The adjustable shoulder stock apparatus as defined in claim 1, wherein the bolt is positioned in a tapered borehole that includes a recess defined by the shoulder stock, wherein a spring is positioned in the recess adjacent the bolt.

4. The adjustable shoulder stock apparatus as defined in claim 1, wherein a surface of the lever is to engage a surface of a block of the shoulder stock.

5. The adjustable shoulder stock apparatus as defined in claim 1, wherein the lever comprises a lip to enable the lever to be pivoted about the second edge to remove the shoulder stock from the connecting piece.

6. The adjustable shoulder stock apparatus as defined in claim 5, wherein, in a resting position, the lip is unable to be grasped to adjust a length of the shoulder stock relative to the connecting piece.

7. The adjustable shoulder stock apparatus as defined in claim 5, wherein, in a resting position, the lip engages a portion of the shoulder stock.

8. The adjustable shoulder stock apparatus as defined in claim 1, wherein the lever and the shoulder stock are made of a plastic material.

9. An adjustable shoulder stock apparatus for use with firearms, comprising:

a shoulder stock;

a bolt movably positioned in a borehole defined by the shoulder stock, wherein the bolt is to removably engage one of a plurality of boreholes defined by a connecting piece of a firearm;

a lever pivotably coupled to the bolt via a swivel cross pin, wherein the lever is pivotable about a first edge in a first direction to disengage the bolt from the one of the plurality of boreholes and wherein the lever is pivotable in the first direction about a second edge defined by the shoulder stock, which is different from the first edge, to move an end of the bolt a distance from a horizontal surface of the shoulder stock to enable the shoulder stock to be attached or removed from the firearm; and a plurality of lateral flanks to prevent the lever from being impacted, wherein the lever is positioned between the plurality of lateral flanks such that to pivot the lever relative to the first edge, a force is to be exerted on a portion of the lever between the plurality of lateral flanks.

10. The adjustable shoulder stock apparatus as defined in claim 9, wherein the lever includes a protrusion configured to engage a wall of the shoulder stock to prevent the protrusion from pivoting past the wall toward the front of the firearm.

11. The adjustable shoulder stock apparatus as defined in claim 9, wherein the lever includes a lip to enable the lever to be pivoted about the second edge after the lever has been pivoted about the first edge.

12. The adjustable shoulder stock apparatus as defined in claim 9, wherein the swivel cross pin does not extend from a molded material of the lever.

13. The adjustable shoulder stock apparatus as defined in claim 9, wherein an interaction between the lever, the plurality of lateral flanks, and a surface of the shoulder stock substantially prevents moisture from penetrating an interior of the shoulder stock.

14. The adjustable shoulder stock apparatus as defined in claim 9, further comprising a spring adjacent the bolt to urge the bolt toward the one of the plurality of boreholes.

15. An adjustable shoulder stock apparatus for use with firearms, comprising:

a shoulder stock into which a connecting piece of a firearm is to be inserted, wherein the connecting piece defines a plurality of boreholes;

a bolt having an end to be inserted in one of the plurality of boreholes to secure the shoulder stock relative to the connecting piece;

a lever that defines a recess that is open toward a top of the firearm and is closed toward a bottom of the firearm into which an opposite end of the bolt is to be positioned and pivotably coupled to the lever via a swivel cross pin, wherein the lever is pivotable about a first edge in a first direction to remove the bolt from the one of the plurality of boreholes to enable a position of the shoulder stock to be adjusted relative to the connecting piece;

a plurality of lateral flanks of the shoulder stock between which the lever is positioned; and a second edge different from the first edge about which the lever is to pivot in the first direction to remove the shoulder stock from the connecting piece.

16. The adjustable shoulder stock apparatus as defined in claim 15, wherein the lever comprises a projection to engage a wall of the shoulder stock to prevent movement of the lever past the wall.

17. The adjustable shoulder stock apparatus as defined in claim 15, wherein the swivel cross pin does not protrude beyond a molded material of the lever.

18. The adjustable shoulder stock apparatus as defined in claim 15, further comprising a spring adjacent the bolt to urge the bolt toward the one of the plurality of boreholes.

19. The adjustable shoulder stock apparatus as defined in claim 15, wherein an interaction between the lever and the plurality of lateral flanks substantially prevents moisture from penetrating an interior of the shoulder stock.

* * * * *